US007708158B2

(12) United States Patent
Sommer et al.

(10) Patent No.: US 7,708,158 B2
(45) Date of Patent: May 4, 2010

(54) CALF BOTTLE

(75) Inventors: Timothy Sommer, Flower Mound, TX (US); Bobby D. Burkham, Ponder, TX (US)

(73) Assignee: Walco International, Inc., Westlake, TX (US)

( * ) Notice: Subject to any disclaimer, the term of this patent is extended or adjusted under 35 U.S.C. 154(b) by 1562 days.

(21) Appl. No.: 10/995,452

(22) Filed: Nov. 23, 2004

(65) Prior Publication Data

US 2006/0108311 A1 May 25, 2006

(51) Int. Cl.
*B65D 1/46* (2006.01)

(52) U.S. Cl. ..... 215/43; 215/42; 215/11.1

(58) Field of Classification Search ..... 215/43, 215/11.1, 42; 119/71, 72, 77, 464, 475, 477
See application file for complete search history.

(56) References Cited

U.S. PATENT DOCUMENTS 2,699,169 A * 1/1955 Perreault ..... 215/11.5
2,709,434 A * 5/1955 Pancoast ..... 215/11.5
2,805,663 A * 9/1957 Robinson et al. ..... 215/11.1
3,009,196 A * 11/1961 Hagen ..... 264/533
3,216,397 A * 11/1965 Pickard ..... 119/71
3,537,498 A * 11/1970 St Amand ..... 604/403
3,581,928 A * 6/1971 St. Amand ..... 215/375
3,916,048 A * 10/1975 Wailes ..... 428/35.9
RE29,065 E * 12/1976 Uhlig ..... 264/530
D249,076 S * 8/1978 Meeker et al. ..... D30/132
4,257,525 A * 3/1981 Thompson ..... 215/396
4,520,936 A * 6/1985 Lyons ..... 215/375
RE34,725 E * 9/1994 Braden ..... 119/515
5,377,852 A * 1/1995 Demorest ..... 215/11.1
5,769,285 A * 6/1998 Upham et al. ..... 222/481.5
5,797,505 A * 8/1998 Kaura ..... 215/11.5
2002/0108925 A1* 8/2002 Mihashi ..... 215/373
2004/0091649 A1* 5/2004 Ruppman et al. ..... 428/35.7

FOREIGN PATENT DOCUMENTS

FR 1473149 A * 3/1967

* cited by examiner

*Primary Examiner*—Sue A Weaver
(74) *Attorney, Agent, or Firm*—Lawrence E. Laubscher, Jr.

(57) ABSTRACT

A calf bottle is characterized by an improved neck design which prevents deposits and microbes from collecting therein. The bottle is in the form of a hollow container having top, side and bottom walls which define a chamber for receiving formula for feeding calves. The top wall includes a neck portion having a central opening and an annular lip surrounding the opening for receiving a removable nipple. The inner wall of the neck portion has a cylindrical configuration of constant diameter.

3 Claims, 2 Drawing Sheets

CALF BOTTLE

BACKGROUND OF THE INVENTION

In the course of rearing calves, they are often fed a formula via a bottle. The bottle includes a removable nipple configured to resemble a cow teat to deliver a controlled amount of formula to the calf as the calf sucks on the bottle. The bottle is re-usable and washed before being re-filled with formula or another nutritional supplement.

BRIEF DESCRIPTION OF THE PRIOR ART

Nursing bottles for calves are well-known in the prior art. Such bottles are typically formed of synthetic plastic material and include a tapered neck portion having an opening in the top through which formula or other nutritional materials are inserted into the bottle. A nipple is fastened about an outer annular lip surrounding the neck area for suckling by a calf to remove the formula from the bottle.

A major drawback to conventional calf bottles lies in the configuration of the inner wall surface in the neck area of the bottle. That is, for ease of manufacture by a molding process, the entire bottle has a uniform thickness. Thus, the inner surface of the bottle conforms with the configuration of the outer surface. In the neck area, an annular cavity is formed beneath the opening and inside the lip of the neck. During use, the cavity accumulates deposits such as calcium, microbes, and other materials from the formula being fed to the calf. These deposits often dry and harden between the time the bottle is used and the time it is cleaned. During cleaning, the deposits are not always completely removed from the bottle and they contaminate the next batch of formula or supplements added to the bottle. The present invention was developed in order to overcome these and other drawbacks of the conventional calf bottles by eliminating the cavity within the bottle behind the lip.

SUMMARY OF THE INVENTION

Accordingly, the present invention relates to a bottle for nursing calves. The bottle is a hollow container including top, side and bottom walls defining a chamber, with the top wall including a neck portion containing an opening which communicates with the chamber. The neck portion has an outer annular lip which surrounds the opening and provides a structure for removably connecting a nipple on the top of the container. The neck further includes an inner cylindrical wall portion having a constant diameter. The cylindrical inner wall prevents deposits from collecting in the neck area of the container.

The bottom wall of the container includes a plurality of spaced protrusions extending downwardly therefrom which assist in leveling the container when it is place on a horizontal surface.

The container is preferably formed of synthetic plastic material which is blow-molded to the desired configuration. The inner wall surface of the container is finished to a degree of smoothness of no greater than four microns so that bacteria can not accumulate thereon.

BRIEF DESCRIPTION OF THE FIGURES

Other objects and advantages of the invention will become apparent from a study of the following specification when viewed in the light of the accompanying drawing, in which.

DETAILED DESCRIPTION

Figure 5:
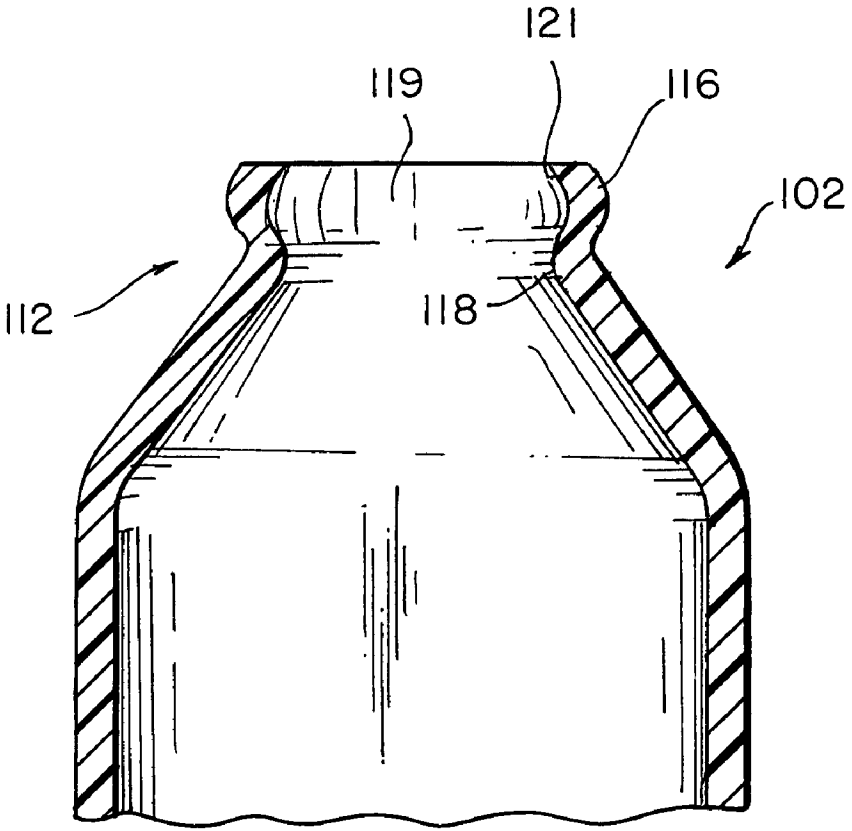
FIG. 5 PRIOR ART
FIG. 5. is a partial sectional view of a calf bottle according to the prior art.

The calf bottle according to the invention is shown in FIGS. 1-4 and comprises a hollow container 2 having top 4, side 6 and bottom walls 8 defining a chamber 10 which is filled with formula or other nutritional materials for delivery to a suckling calf as will be developed below. The top wall rises upwardly from the side walls and terminates in a neck portion 12 containing a central opening 14 which communicates with the chamber for filling and emptying the contents of the bottle.

Figure 3:
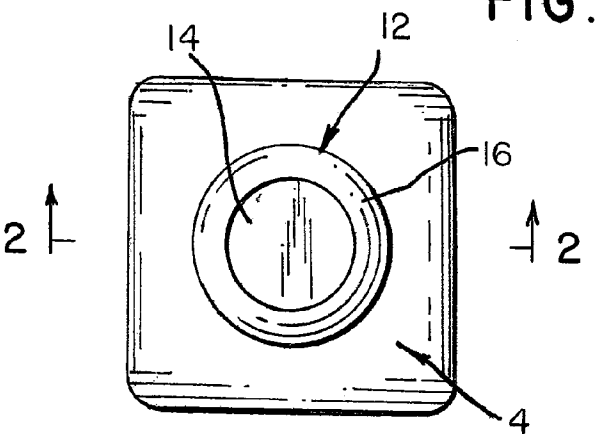
FIGS. 3 and 4 are top and bottom plan views, respectively, of the bottle of FIG. 1.
Figure 2:
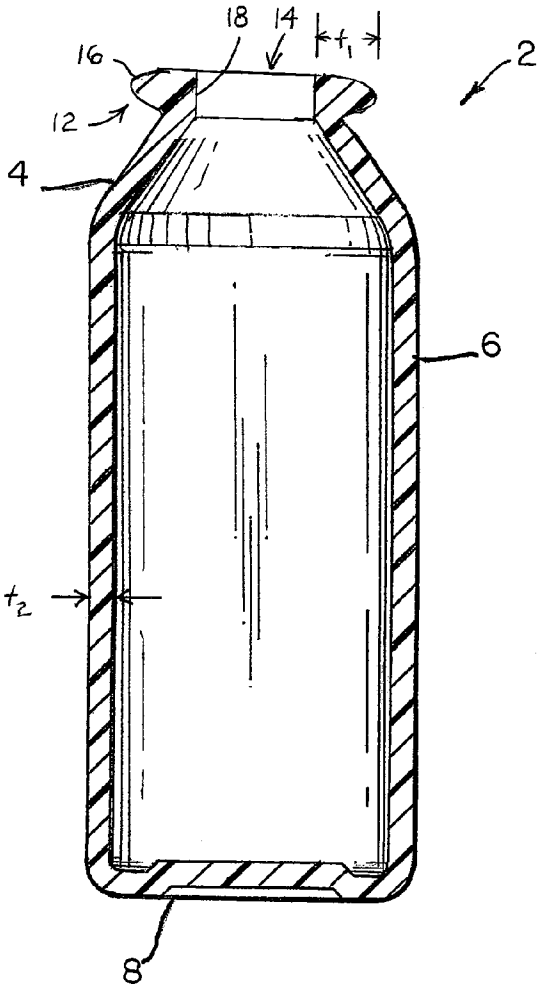
FIG. 2 is a front sectional view of the bottle of FIG. 1.

The neck portion 12 extends vertically upwardly from the top wall 4. As shown in FIGS. 2 and 3, the neck portion includes an outer annular lip 16 which extends around the opening 14. The lip defines a ledge about the bottom portion of a nipple (not shown) is arranged so that the nipple can be removably connected with the bottle. As is known in the art, the nipple has an upper end portion configured to resemble the teat of a cow so that a calf can suck on the nipple to draw formula from the container.

The inner wall 18 of the neck portion has a generally cylindrical configuration as shown in FIG. 2. Preferably, the inner wall has a constant diameter along its length so that as shown in cross-section in FIG. 2, the wall is straight and vertical, although manufacturing tolerances may result in some variation in the inner wall surface configuration. The thickness $t_1$ of the neck portion is thus greater than the thickness $t_2$ of the remaining wall portions of the container. Because the inner wall has a cylindrical configuration, there are no cavities in the neck area in which deposits may collect. This facilitates cleaning of the bottle for re-use without contamination from prior contents of the bottle.

Figure 1:
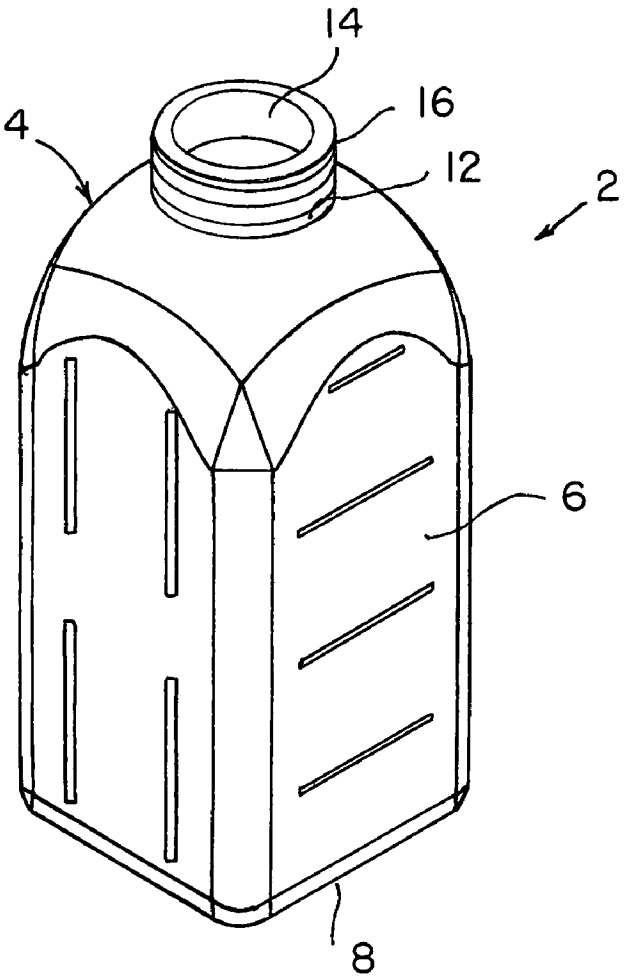
FIG. 1 is a perspective view of the calf bottle according to the invention.
Figure 4:
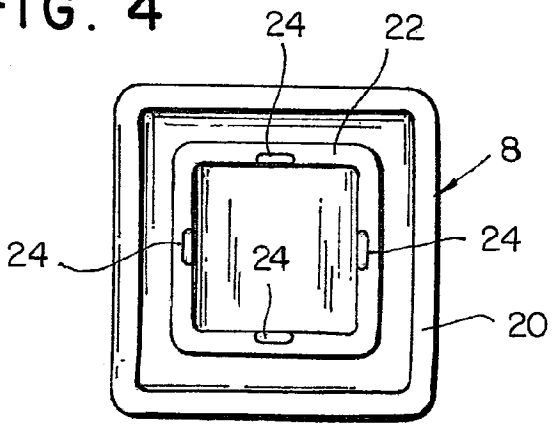

Referring now to FIG. 4, the bottom wall 8 of the container includes an outer rim 20 and an inner rim 22 which has a plurality of protrusions 24 extending therefrom. The protrusions are preferably equally spaced about the inner rim and assist in leveling the container when it is placed on a horizontal surface. The container preferably has four side walls which define a square horizontal cross-sectional configuration as shown in FIGS. 1 and 4. With such a configuration, four protrusions are spaced about the bottom wall as shown in FIG. 4.

The container is preferably formed of synthetic plastic material by a blow-molding process. Suitable materials are copolymers or medium to high density polyethylene based composite materials which provide sufficient strength and durability for sudden shock loading impacts and harsh environments. The inner wall surfaces of the container are finished to a smoothness of four microns or better to prevent bacteria from adhering thereto.

The blow-molding process for forming the calf bottle is unique in that it enables the bottle to be formed with a thicker neck region required by the cylindrical inner wall portion thereof relative to the thickness of the remaining portions of the bottle. The bottom wall can also be thicker than the side walls if desired for increased durability. The variable thickness of the bottle in different regions thereof is achieved through the use of variable extrusion orifices in the blow molding apparatus throughout the length of the bottle. In addition, defining the inner wall surface of the bottle with the desired degree of smoothness is achieved via a combination of the variable extrusion orifices and variable temperature cooling mechanisms at specific locations of the molded bottle.

The thermal transfer within the bottle during the blow molding process varies considerably from the bottom to the top, causing the bottle to shrink unevenly and distorting its final shape. To counteract these variations, chilled water at different temperatures and volumes is circulated through the mold apparatus in the neck, side and bottom regions of the bottle so that the bottle cools uniformly.

In FIG. 5 is shown a conventional calf bottle 102. The neck area 112 has an outer annular lip 116 for attachment of a nipple. The inner wall surface 118 of the neck area conforms to the configuration of the outer wall surface of the neck area and the thickness of the neck area is uniform. Because of the configuration of the inner wall, a cavity 119 is defined within the neck area behind the lip 116. This cavity collects deposits from the contents of the bottle which are retained in the cavity after the bottle has been used. The deposits harden within the cavity and are difficult to remove when the bottle is cleaned. Deposits which remain in the bottle for re-use contaminate the formula added to the bottle for feeding a subsequent calf. In addition, the conventional bottles include a sharp edge 121 where the top edge of the inner wall meets the opening. This edge often cuts the fingers and hands of those handling the bottles during cleaning, filling, or application and removal of the nipple.

The calf bottle according to the invention eliminates the cavity in the neck area and the sharp edge around the inner circumference of the opening. Thus, contamination of the bottle contents and injury to bottle handlers is avoided.

While the preferred forms and embodiments of the invention have been illustrated and described, it will be apparent to those of ordinary skill in the art that various changes and modifications may be made without deviating from the inventive concepts set forth above.

What is claimed is:

1. A nursing bottle for calves, comprising a blow-molded synthetic plastic container including top, side, and bottom walls defining a chamber, said container including a neck portion extending from said top wall and containing an opening communicating with said chamber, said neck portion including (a) an outer annular lip surrounding the opening for attachment of a nipple; and (b) a generally cylindrical inner wall surface having a constant diameter and finished to a degree of smoothness of no greater than four microns, said neck portion having a thickness greater than the thickness of said top, side and bottom walls, said neck inner wall surface preventing deposits and bacteria from collecting in the neck portion of said container.

2. A nursing bottle as defined in claim 1, wherein said bottom wall includes a plurality of spaced protrusions extending therefrom to assist in leveling the bottle when it is placed on a horizontal surface.

3. A nursing bottle as defined in claim 2, wherein said container includes four side walls and has a generally square horizontal cross-sectional configuration.

* * * * *